United States Patent [19]

Golden

[11] Patent Number: 5,048,987

[45] Date of Patent: Sep. 17, 1991

[54] PAPER GUIDE FOR TRACTOR FEED PRINTERS

[76] Inventor: Phyllis S. Golden, 591-F E. Bonita Ave., San Dimas, Calif. 91733

[21] Appl. No.: 457,265

[22] Filed: Dec. 27, 1989

[51] Int. Cl.[5] ..... B41J 15/04

[52] U.S. Cl. ..... 400/613.1; 400/616; 226/92

[58] Field of Search ..... 400/613.1, 616, 616.1, 400/642; 226/6, 92

[56] References Cited

U.S. PATENT DOCUMENTS

| | | | |
|---|---|---|---|
| 4,070,223 | 1/1978 | Stalzer | 400/616.1 |
| 4,545,517 | 10/1985 | Olson | 226/92 |
| 4,759,484 | 7/1988 | Richter | 226/6 |

*Primary Examiner*—David A. Wiecking
*Assistant Examiner*—Ren Yan
*Attorney, Agent, or Firm*—William L. Chapin

[57] ABSTRACT

An accessory for use with perforated paper of the type used in electro-mechanical printers having a tractor wheel feed mechanism facilitates inserting the leading edge of a length of paper into the tractor feed mechanism. The paper guide accessory consists of a thin, rectangular sheet of strong, flexible material, preferably made of transparent plastic film such as polyester film, folded over on itself and creased to form a lower, rear half-sheet and a somewhat shorter upper, front half-sheet, thereby forming a pocket between the upper and lower half-sheets. Laterally aligned pairs of circular perforations located near the outer longitudinal edges of the guide, are provided through the thickness dimension of both upper and lower half-sheets. Pairs of perforations are provided at regular longitudinal intervals, and are of the proper size and spacing to register with perforations in paper inserted into the pocket. With the leading lateral edge of a length of perforated computer paper sandwiched between the upper and lower half-sheets of the guide, and the perforations in the guide aligned with the paper perforations, quick and easy insertion of the paper into the tractor feed mechanism is facilitated, while protecting the paper from tearing.

8 Claims, 1 Drawing Sheet

PAPER GUIDE FOR TRACTOR FEED PRINTERS

BACKGROUND OF THE INVENTION

1. Field of the Invention

This invention relates to accessories for paper used in electro-mechanical printers connected to computers used in data processing and related applications. More particularly, the invention relates to an accessory which minimizes tearing of perforated continuous sheets of paper, of the type having circular perforations on opposite sides of the paper for engagement by the sprocket pins of a printer tractor-feed mechanism.

2. Description of Background Art

Electro-mechanical printers are used extensively as output devices for computers, providing a permanent printed record on paper, referred to as "hard copy" of data stored in the computer. The hard copy description is used to differentiate printed data from data displayed temporarily on the cathode ray tube (CRT) screen or other visual data output display device used with the computer. Computer driven printers are also used extensively to print letters, forms and envelopes in applications referred to collectively as word processing.

One or the other of two different types of mechanisms are commonly used to feed paper through computer printer mechanisms. One type of paper feed mechanism uses a pair of elongated cylindrical rollers having resilient surfaces which exert pressure on opposite sides of a sheet of paper, and are rotated in opposite directions to draw the paper longitudinally between the rollers. This type of feed mechanism, which is sometimes referred to as a friction drive, is used in most typewriters.

A second type of paper feed mechanism commonly used in computer printers uses a pair of parallel, laterally spaced apart, coaxial "tractor" wheels to feed paper through the printer. In this type of feed mechanism, frequently referred to as a tractor mechanism or tractor-feed mechanism, the tractor-feed wheels have radially outwardly projecting pins or sprockets, spaced at regular intervals along the outer circumference of each wheel. The spacing between tractor pins is chosen to match the longitudinally spacing between circular perforations provided on opposite lateral sides of perforated computer paper, which is usually supplied as long, continuous sheet. Customarily, perforated computer paper is supplied as a zig-zag (fan-folded) sheet which can fit in a box of compact size.

Tractor feed printers have certain advantages over friction roller printers. Thus, the lateral positioning of characters printed on paper fed by a tractor-feed mechanism is precisely repeatable, while paper fed by a friction roller mechanism can move laterally with respect to the printing elements. Also, paper fed by friction rollers may become skewed diagonally with respect to the feed direction, causing the printed lines to be inclined from the horizontal. In tractor feed printers, the fixed geometrical relationship between tractor wheel sprockets and paper perforations prevents line skew from occurring.

A disadvantage of tractor-feed mechanisms is their tendency to sometimes tear paper fed through the mechanism. This is particularly likely to occur at the time the leading edge of a strip of perforated paper is first fed into the mechanism, when only a single pair of laterally paired holes at the leading edge of the strip are engaged by tractor wheel pins. At this point, longitudinal stress on the paper is greatest, as is the likelihood that the paper will tear. This susceptibility to tearing is particularly great for paper sheets which are scored along lateral and longitudinal edges, to permit tearing off single sheets of paper after they have been fed through the printer. Scored or partially perforated paper of this type is used to print computerized letters on letterheads which appear to have been individually typed, a ploy commonly used by politicians in sending mass mailings to their constituents.

Obviously, it would be desirable to minimize the loss of perforated computer paper due to tearing by a printer tractor mechanism. This is especially true of perforated computer paper which bears scored, pre-printed forms such as letterheads, since these are substantially more expensive than blank or stock computer paper. Moreover, the time which must be taken by the printer operator to remove torn paper and re-insert a fresh, untorn edge present a significant economic waste. With these considerations in mind, the present invention was conceived.

In searching the literature for articles possibly related to the subject matter of the present invention, the following peripherally related patents were found:

Weingarten, U.S. Pat. No. 4,448,558, May 15, 1984, Computer Printer Paper Support Discloses an accessory for supporting unperforated papers, forms, stationery and the like for advancement through the pin feed mechanism of a computer printer or the like. The accessory comprises a pair of flexible strips each having near one longitudinal edge thereof a plurality of regularly spaced holes for engaging the sprockets of the pin type feed mechanism of a computer printer or the like. Near the other longitudinal edge of each strip is a strip of non-setting, non-permanent adhesive for firmly, but removably securing papers for advancement into the printer.

Swiss Patent 61,442, Lauener, July 5, 1912, Card Holder Typewriters

Discloses a card or sheet approximately the size of a sheet of typing paper having tabs a and b for supporting post cards and the like for advancement into the typewriter.

German Patent 1,149,726, June 6, 1963, Jung, Conveyor Band

Discloses a conveyor band for moving in overlapping fashion envelopes, bags, cards, etc., through a tabulating machine, typewriter, etc. The band has marginal perforations and is folded so as to form pockets. The depth of the pockets is determined by the size of the envelopes, etc., and by the perforations.

French Patent, 2,595,625, Sept. 1987, Gran, Support For Papers Fed Through Printer Discloses supports for papers fed through a tractor printer comprising a pair of perforated strips having self-adhesive tabs for non-setting attachment to the papers to be fed through the printer.

None of the above-cited patents, nor any other prior art which the present inventor is aware of, discloses a solution to the specific tearing problem described above.

OBJECTS OF THE INVENTION

An object of the present invention is to provide an accessory for use with continuous forms and/or continuous sheets of perforated paper, of the type used in computer tractor-feed printers, which facilitates fast, simple loading of the paper into the tractor-feed mechanism.

Another object of the invention is to provide an accessory for use with computer tractor-feed mechanisms which decreases the likelihood of tearing the perforated paper along longitudinal score lines, or bursting edges, when the leading edge of the paper is inserted into a tractor-feed mechanism.

Another object of the invention is to provide a tear protection accessory for use with perforated paper fed into a tractor-feed mechanism, which is simply and easily attached to the leading edge of the paper.

Another object of the invention is to provide a tear protection guide for perforated paper used in tractor-feed printers which is light weight, easy to manufacture, and low in cost.

Various other objects and advantages of the present invention, and its most novel features, will become apparent to those skilled in the art by perusing the accompanying specification, drawings and claims.

It is to be understood that although the invention disclosed herein is fully capable of achieving the objects and providing the advantages described, the characteristics of the invention described herein are merely illustrative of the preferred embodiment. Accordingly, I do not intend that the scope of my exclusive rights and privileges in the invention be limited to details of the embodiments described. I do intend that equivalents, adaptations and modifications of the invention reasonably inferrable from the description contained herein be included within the scope of the invention as defined by the appended claims.

SUMMARY OF THE INVENTION

Briefly stated, the present invention comprehends an accessory for use with paper of the type provided with laterally aligned pairs of circular perforations at regular longitudinal intervals on opposite side edges of the paper, adapting the paper to be driven in a longitudinal direction by a pair of sprocket wheels used in a tractor-feed printer. The purpose of the accessory is to facilitate quick and easy insertion of the leading edge of the paper into a tractor-feed mechanism with the holes at the leading edge of the paper correctly registered with and engaged by the radially projecting sprockets or pins from both drive wheels, and to minimize tearing of the paper and resulting loss of productive time during the loading process.

The paper guide accessory according to the present invention is preferably fabricated from a thin, rectangular sheet of strong, flexible material such as polyester film. The width of the sheet is made substantially the same as that of the perforated paper with which the guide is intended to be used. The film sheet is folded over on itself in the longitudinal direction to form a pocket for receiving the leading lateral edge of a sheet of perforated paper. Circular perforations are provided through both portions of the film sheet comprising the pocket, in laterally aligned pairs at regular longitudinal intervals on opposite edges of the film sheet. The lateral and longitudinal spacing of the perforations are of the proper dimensions to place the film sheet perforations in registration with the perforations in a sheet of standard computer paper inserted into the pocket formed in the film sheet. Preferably, the film sheet is transparent to facilitate alignment of the guide perforations with the paper perforations.

With the leading edge of the paper sheet inserted into the paper guide with perforations in the sheet aligned with those of the paper guide, the guide and paper sandwiched between the upper and lower sides of the guide are inserted into a tractor feed mechanism of a printer. The relative stiffness of the folded leading edge of the guide facilitates engagement by sprocket pins of the tractor guide of the registered paper and guide perforations, making loading of the paper easier and quicker than would be normally possible without use of the guide. Also, the reinforcement action of the film sheet of the guide, which is substantially stronger than paper, prevents tension exerted by the sprocket wheels on the paper from tearing the paper during the loading operation.

After a sheet of paper has been fully loaded into the tractor mechanism, the guide may be removed when it has advanced through the tractor mechanism sufficiently for the perforations of the guide to disengage from the sprocket pins, allowing the guide to be re-used.

DESCRIPTION OF THE PREFERRED EMBODIMENT

Figure 1:
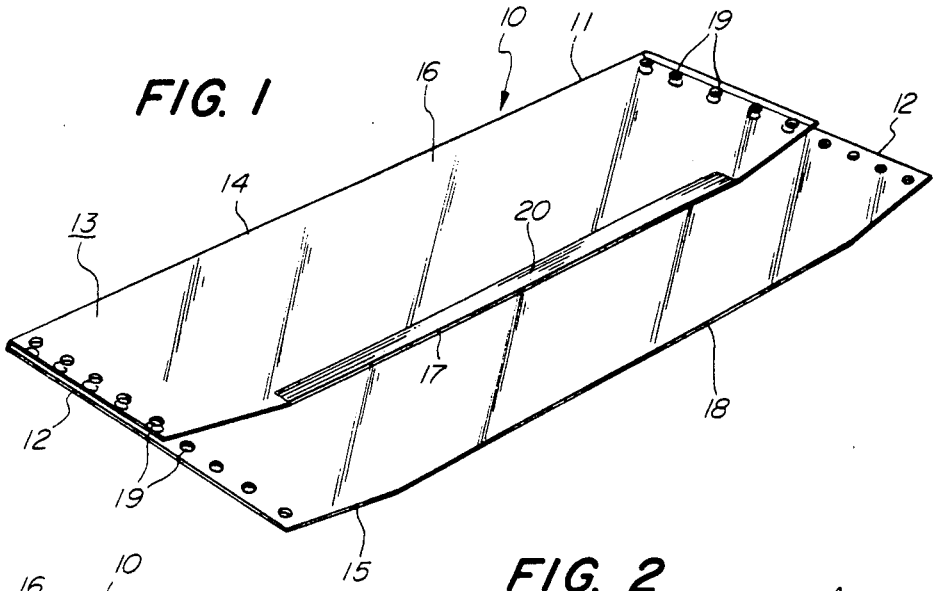
FIG. 1 is a perspective view of a tear protection paper guide accessory for computer tractor feed printers according to the present invention.
Figure 2:
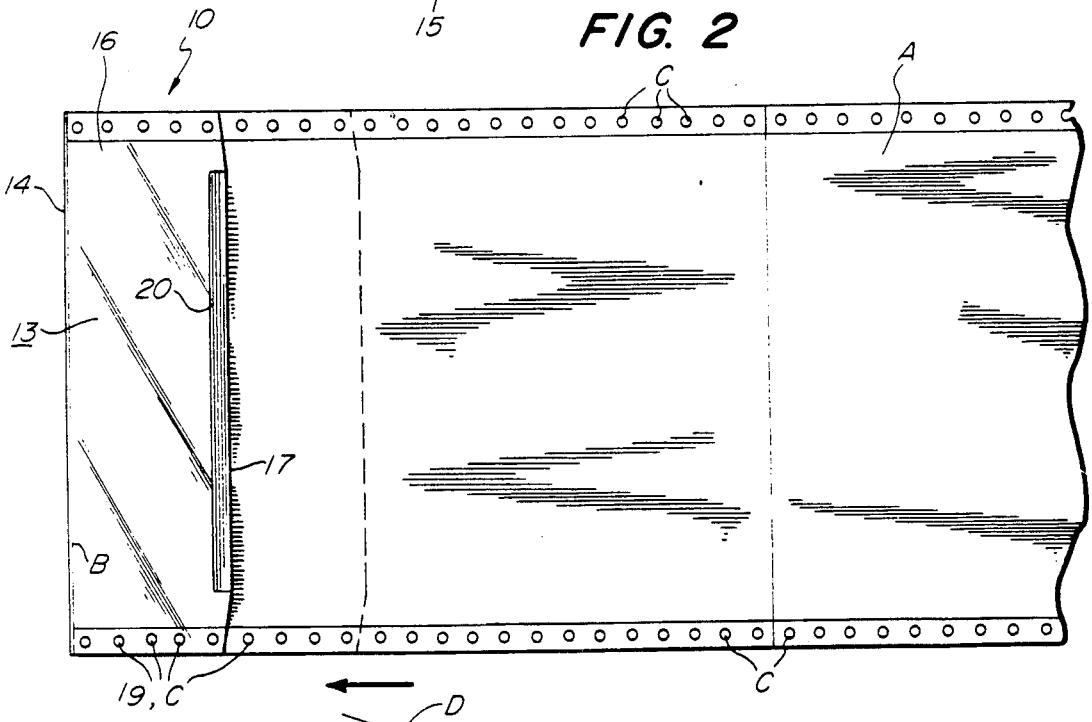
FIG. 2 is a plan view of the paper guide of FIG. 1, showing the leading edge of a sheet of perforated computer paper inserted into the guide.
Figure 3:
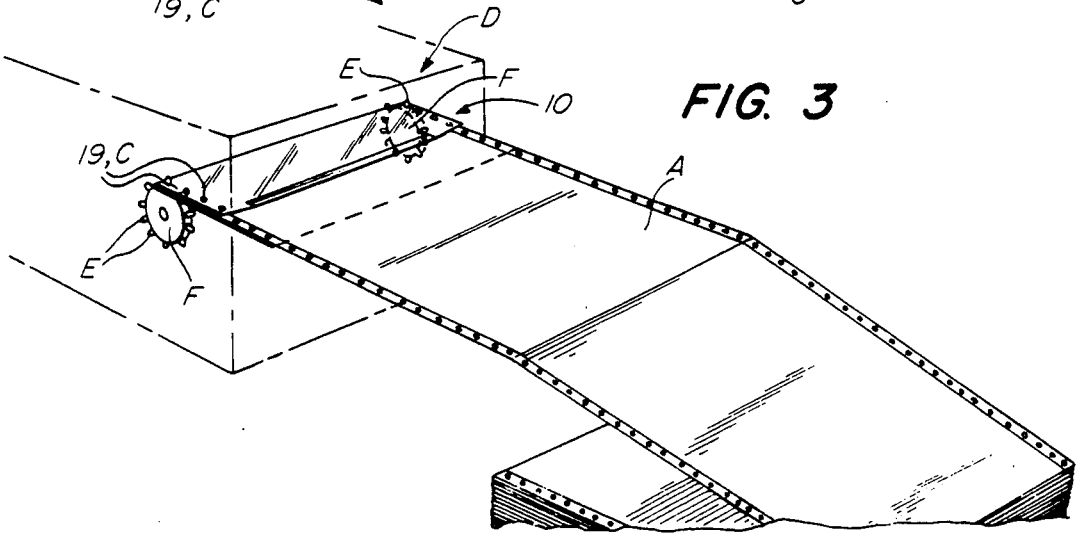
FIG. 3 is a perspective view of the guide and paper of FIG. 2, showing the guide and paper being inserted as a unit into the tractor feed mechanism of a computer printer.

Referring now to FIGS. 1 through 3, a tear protection paper guide for computer tractor feed printers is shown.

As may be seen best by referring to FIG. 1, the paper guide 10 has the general appearance of a rectangular sheet 11 of thin, flexible material, the front longitudinal portion which is folded on a line perpendicular to the lateral sides 12 of the sheet, to form a laterally disposed, rectangular pocket 13. Thus folded, sheet 11 has a folded leading edge 14, a lower half sheet 15, and an upper half sheet 16. Upper half sheet 16 is preferably of shorter longitudinal extent than that of lower half sheet 15, thus positioning the rear edge 17 of the upper half sheet forward of the rear edge 18 of the lower half sheet.

Sheet 11 is preferably transparent and is preferably fabricated from a thin, flexible strong material, such as polyester film having a thickness in the approximate range of 0.5 to 5 mils, with a preferred thickness of about 1 to 2 mils. Other materials may be used to fabricate sheet 11, such as cellulose acetate butyrate, commonly referred to as "acetate." Whatever material is chosen for sheet 11, it should have a greater resistance to tearing than paper, and be relatively resistant to stretching.

As shown in FIG. 1, sheet 11 of tear protection guide 10 has a plurality of laterally aligned pairs of circular perforations 19, one perforation of a pair being located just inwards from each lateral side 12 of the sheet. The perforations 19 extend through both lower half 15 and upper half 16 of sheet 11, and are spaced apart at regular longitudinal intervals.

The lateral spacing between each perforation 19 of a pair, the longitudinal spacing between adjacent pairs of perforations, and the diameter of each perforation are all selected to register with perforations in the paper which the guide is intended to be used with. Thus, for guide 10 to be used with standard American computer paper, the lateral center-to-center spacing between perforations should be about 9 inches, the longitudinal center-to-center spacing about ½ inch, and the hole diameter about 3/16 of an inch. The width of guide 10 is also selected to match the width of the perforated paper which the guide is intended to be used with. Thus, for standard American perforated computer paper, the width of guide 10 should be 9½ inches.

The length of tear protection guide 10 may be any convenient value. It has been found by the inventor that a length of about 5 inches for lower half-sheet 15 of sheet 11, and a length of about 2¾ inches for upper half-sheet 16 are satisfactory. Preferably, the rear edge 17 of upper half sheet 16 contains an identifying marker such as a printed bar 20. The purpose of the marker bar 20 is to permit the rear edge 17 of upper half sheet 16, which is transparent, to be readily located and pulled away from the lower half-sheet 15, to permit the leading edge of a sheet of computer paper to be inserted into pocket 13 of the guide, a process which will now be described.

FIGS. 2 and 3 illustrate the manner in which tear protection guide 10 is used to facilitate inserting the leading edge of a sheet of perforated computer paper into the tractor feed mechanism of a computer printer, while minimizing the likelihood of tearing the paper during the loading of the sheet into the printer.

As shown in FIG. 2, the leading edge B of the first sheet of a supply of fan-folded computer printer paper A is inserted into pocket 13 of tear protection guide 10, the rear edge 17 of upper half-sheet 16 being lifted upwards to provide ready access to pocket 13. The upper half-sheet 16 of guide 11 is then allowed to fall back down into flush contact with the upper surface of paper sheet A, and the guide and sheet moved relative to one another, if necessary, to bring perforations 19 of the guide into registration with perforations C of the paper sheet.

With paper sheet A sandwiched between the upper half sheet 16 and lower sheet 15 of guide 10, the leading edge B of the paper sheet is aligned with the leading edge 14 of the guide, and perforations 19 of the guide are aligned with perforations C of the paper sheet. The guide and paper are then inserted into the tractor feed mechanism D of a printer, as shown in FIG. 3. The pair of guide perforations 19 and paper perforations C nearest the leading edge 14 of the guide 10 are placed down over the nearest available pair of sprocket pins E, which project radially outwards from laterally opposed sprocket wheels F. The sprocket wheels F are then simultaneously rotated forward, either manually or by energization of the sprocket wheel drive motor, depending on the type of tractor mechanism used. When the sprocket wheels have rotated sufficiently to feed the guide 10 forward beyond the wheels, at least two pairs of paper perforations are engaged by sprocket pins. At this point, guide 10 may be pulled off the leading edge B of paper sheet A, and retained for re-use.

The relative stiffness of the folded leading edge 14 of guide 10, sandwiching the leading edge B of paper sheet A, substantially increases the ease with which the leading edge perforations of the paper sheet may be aligned with and placed down over sprocket pins E of the tractor feed mechanism D. Also, the guide 10 provides protection against tearing the front portion of sheet A when it is subjected to the greater tensile force, as the rotating sprocket pins E engage only the first pair of perforations C on paper sheet A. Thus, the novel paper guide according to the present invention is a highly useful accessory for use with perforated computer paper used in tractor feed printers, facilitating the rapid and convenient loading of paper into the tractor mechanism while minimizing the likelihood of tearing the paper during the loading operation.

What is claimed is:

1. An accessory guide for use with elongated rectangular paper stock of the type adapted for use with the tractor feed mechanism of a mechanical printer by being provided with laterally aligned pairs of perforations spaced apart at regular longitudinal intervals on opposite lateral sides of said paper, said perforations being of the proper size and spacing for engagement by radially outwardly projecting pins of laterally spaced apart tractor wheels, said accessory consisting of;

a thin, generally laterally elongated, rectangular sheet of strong, flexible materials, a front longitudinal portion of said sheet being folded approximately 180 degrees back on a rear longitudinal portion of said sheet on a line perpendicular to the lateral sides of said sheet, in overlying relationship to said rear longitudinal portion of said sheet, thereby forming said overlying front folded back portion as an upper half sheet and said underlying rear longitudinal portion as a lower half sheet, said upper and lower half sheets forming a laterally disposed rectangular pocket, said upper and lower half-sheets being provided with registered laterally aligned pairs of circular holes spaced apart at regular longitudinal intervals of the proper dimensions to register with said perforations in said paper, whereby a leading lateral edge of said paper may be inserted into said pocket and said paper perforations aligned with said circular holes, thereby facilitating insertion of said paper into said tractor feed mechanism.

2. The accessory guide of claim 1 wherein said overlying front longitudinal portion of said sheet is shorter than said underlying rear longitudinal portion of said sheet.

3. The accessory guide of claim 2 wherein said sheet is substantially transparent.

4. The accessory guide of claim 3 wherein the rear portion of said upper half-sheet is marked with indicia to render it more visible, thereby facilitating the locating, grasping and lifting up of said upper half sheet relative to said lower half sheet to provide access to said pocket.

5. The accessory guide of claim 1 wherein said sheet is made of flexible plastic film.

6. The accessory guide of claim 5 wherein said upper half-sheet is maintained substantially flush with said lower half-sheet by creasing said fold.

7. The accessory guide of claim 6 wherein said sheet is made of polyester film.

8. The accessory guide of claim 6 wherein said sheet is made of cellulose acetate butyrate film.

* * * * *